US009865186B2

(12) United States Patent
Seal

(10) Patent No.: US 9,865,186 B2
(45) Date of Patent: Jan. 9, 2018

(54) APPARATUS, SYSTEM, AND METHOD FOR DISPLAYING CONTENT ON A VEHICLE

(71) Applicant: Hitch Demon, LLC, Sandy, UT (US)

(72) Inventor: Trevor Seal, Sandy, UT (US)

(73) Assignee: Hitch Demon, LLC, Sandy, UT (US)

( * ) Notice: Subject to any disclaimer, the term of this patent is extended or adjusted under 35 U.S.C. 154(b) by 170 days.

(21) Appl. No.: 13/783,029

(22) Filed: Mar. 1, 2013

(65) Prior Publication Data

US 2013/0231828 A1 Sep. 5, 2013

Related U.S. Application Data

(60) Provisional application No. 61/605,646, filed on Mar. 1, 2012.

(51) Int. Cl.
*G09F 21/04* (2006.01)
*G09F 19/18* (2006.01)

(52) U.S. Cl.
CPC ..... *G09F 21/04* (2013.01); *G09F 19/18* (2013.01); *G09F 21/048* (2013.01)

(58) Field of Classification Search
CPC ..... G09F 19/18; G09F 21/048; G09F 21/04
See application file for complete search history.

(56) References Cited

U.S. PATENT DOCUMENTS 2,023,845 A 12/1935 Larose
3,191,490 A 6/1965 Rabinow
5,518,159 A 5/1996 DeGuevara
5,845,921 A 12/1998 Stimac
6,079,136 A 6/2000 Kozlarek
6,220,737 B1 4/2001 Baragona
6,282,822 B1 * 9/2001 Rinzler ..... B60J 5/14 160/394

(Continued)

FOREIGN PATENT DOCUMENTS

DE 20212462 U1 11/2002
DE 10122977 A1 1/2003

(Continued)

OTHER PUBLICATIONS

PCT/US2013/028740 International Search Report and Written Opinion, dated Jun. 27, 2013.
14520044, Office Action dated Aug. 18, 2015.

*Primary Examiner* — Mussa A Shaawat
(74) *Attorney, Agent, or Firm* — Kunzler PC

(57) ABSTRACT

Methods, systems, and apparatuses for displaying or projecting images on a vehicle are described herein. The methods include receiving location data of a vehicle, determining content corresponding to the location, and providing images corresponding to the content to projectors for display on a side of a vehicle. The systems include a vehicle, projectors mounted on the vehicle such that an image created by the projector is cast on a surface of the vehicle, and a control module configured to provide images to the one or more projectors for display on a side of the vehicle. The apparatuses include a location module that determines a current location of a vehicle, a content selection module that determines a content corresponding to the current location, and a display module that provides images corresponding to the content to one or more projectors for display on a side of a vehicle.

13 Claims, 9 Drawing Sheets

(56) References Cited

U.S. PATENT DOCUMENTS 6,489,934 B1 12/2002 Klausner
6,641,041 B2 11/2003 Olds et al.
6,655,822 B1 12/2003 Sylvester
6,685,347 B2 2/2004 Grutze
6,733,134 B2 5/2004 Bleiner
7,054,740 B2 5/2006 Chinomi et al.
7,154,383 B2 12/2006 Berquist
7,175,321 B1 2/2007 Lopez
7,327,516 B2 2/2008 Wheeler
7,407,294 B2 8/2008 Choi
7,440,842 B1 10/2008 Vorona
7,470,030 B2 12/2008 Devos et al.
7,874,681 B2 1/2011 Huebner
7,901,083 B2 3/2011 Destain et al.
8,091,822 B2 1/2012 Boyce
8,606,430 B2 12/2013 Seder et al.
8,608,317 B2 12/2013 Babst et al.
8,651,664 B2 2/2014 Harvey et al.
8,733,939 B2 5/2014 Othmer
8,781,968 B1 * 7/2014 Bushman ..... G06Q 30/0261 705/14.4
2001/0043313 A1 11/2001 Okura
2001/0052841 A1 * 12/2001 Polyakov ..... G06Q 30/02 340/7.48
2002/0032035 A1 * 3/2002 Teshima ..... G06Q 30/02 455/456.3
2002/0167416 A1 * 11/2002 Polyakov ..... G06Q 30/02 340/691.6
2002/0180936 A1 12/2002 Muehlhoff et al.
2003/0024195 A1 2/2003 Koh et al.
2003/0099104 A1 5/2003 Hou
2003/0193651 A1 10/2003 Egle
2004/0059498 A1 3/2004 Chinomi et al.
2004/0085260 A1 * 5/2004 McDavid, III ..... G03H 1/0005 345/7
2005/0039362 A1 * 2/2005 Slesinski ..... G09F 21/048 40/590
2005/0041212 A1 2/2005 Weidow, III
2006/0130100 A1 * 6/2006 Pentland ..... H04N 7/17318 725/68
2006/0143957 A1 * 7/2006 Salehi ..... G09F 19/18 40/590
2006/0191180 A1 8/2006 Williams et al.
2006/0268233 A1 11/2006 Sato
2007/0153375 A1 7/2007 Peterson et al.
2007/0216136 A1 * 9/2007 Dietz ..... B60D 1/36 280/477
2007/0242471 A1 10/2007 Campbell et al.
2008/0236003 A1 * 10/2008 Raccah ..... G09F 11/29 40/466
2008/0258938 A1 10/2008 Moon
2008/0284983 A1 * 11/2008 Dula ..... G03B 29/00 352/131
2008/0305283 A1 12/2008 Denet
2009/0015798 A1 1/2009 Unsworth
2009/0284960 A1 11/2009 Chien
2010/0036717 A1 2/2010 Trest
2010/0141902 A1 6/2010 Destain et al.
2010/0188204 A1 7/2010 Okada et al.
2010/0253918 A1 10/2010 Seder et al.
2011/0029232 A1 2/2011 Hattori et al.
2011/0032484 A1 2/2011 Seal
2011/0089297 A1 4/2011 Bishop
2011/0188257 A1 8/2011 Sidler
2012/0212712 A1 8/2012 Scanlon
2013/0006775 A1 * 1/2013 Jordan ..... G06Q 30/0265 705/14.62
2013/0147840 A1 * 6/2013 Seder ..... G02B 27/01 345/633
2013/0238409 A1 9/2013 Chatterjee et al.

FOREIGN PATENT DOCUMENTS

EP 2133857 A1 6/2006
EP 2236984 A1 10/2010
JP 2005156269 A 6/2005
JP 2009058799 A 3/2009
WO 01/45065 A2 6/2001
WO 2004/070690 A1 8/2004
WO 2008/091201 A1 7/2008
WO 2014/086992 A1 6/2014

* cited by examiner

APPARATUS, SYSTEM, AND METHOD FOR DISPLAYING CONTENT ON A VEHICLE

FIELD

This invention relates to customizing the appearance of a vehicle and more particularly relates to displaying content on a vehicle.

BACKGROUND

Description of the Related Art

Vehicle manufacturers are constantly in search of mechanisms, methods and styles which customize their vehicles and create unique vehicle designs. Vehicle owners also customize their vehicles to present an image or idea that they find important. Also, companies and small business owners oftentimes look to customize a vehicle as an advertising or promotional tool. Often this is done by painting the vehicle, affixing a large sticker to the vehicle, or purchasing a unique vehicle. These forms of customization and advertising are expensive and time consuming. They are also permanent, or at least require a great deal of work to change.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1:
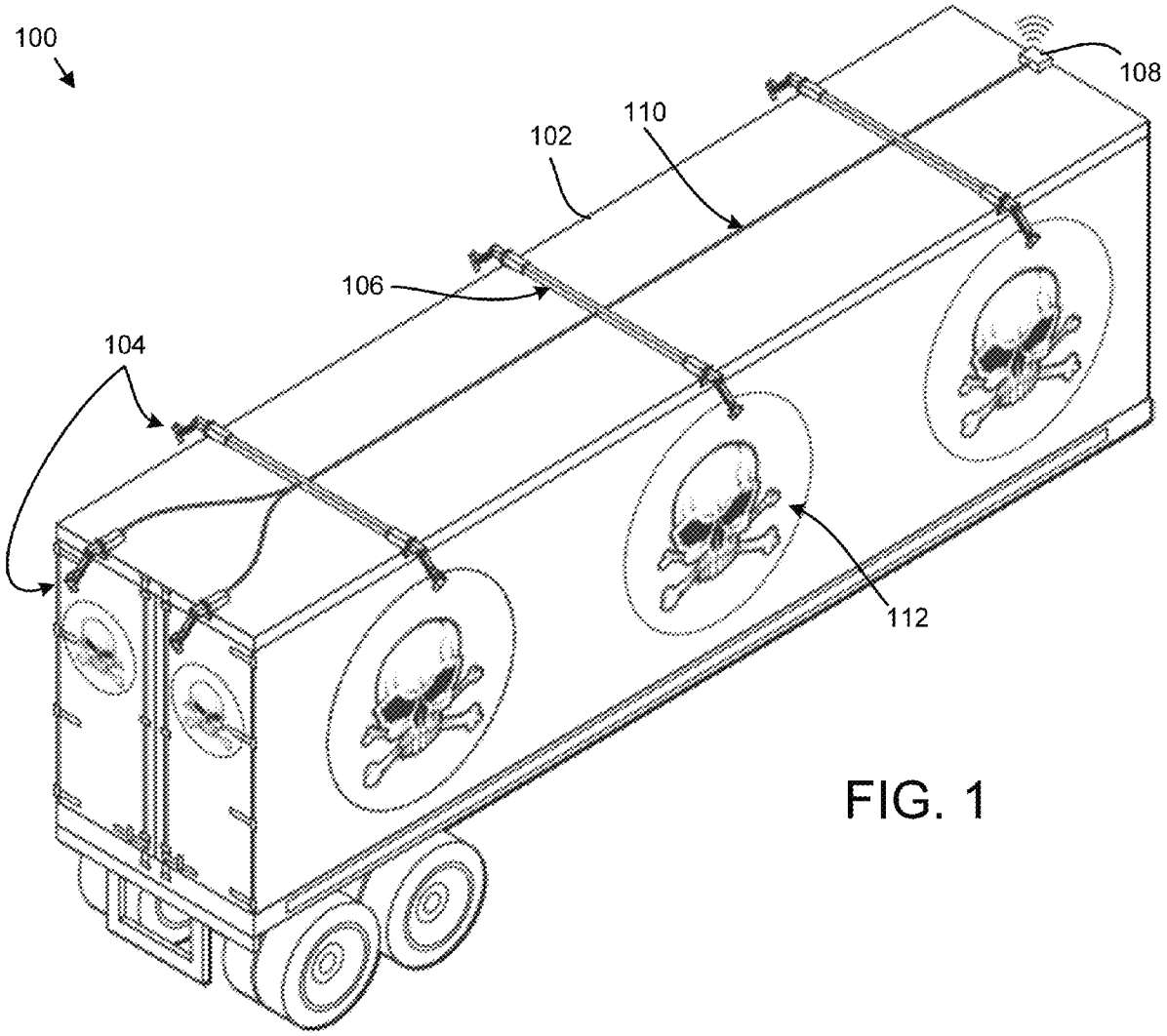
FIG. 1 is perspective view of one embodiment of a vehicle display system in accordance with the present invention.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of executable code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network. Where a module or portions of a module are implemented in software, the software portions are stored on one or more computer readable mediums.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing.

More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Aspects of the present invention are described below with reference to schematic flowchart diagrams and/or schematic block diagrams of methods, apparatuses, systems, and computer program products according to embodiments of the invention. It will be understood that each block of the schematic flowchart diagrams and/or schematic block diagrams, and combinations of blocks in the schematic flowchart diagrams and/or schematic block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the schematic flowchart diagrams and/or schematic block diagrams block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the schematic flowchart diagrams and/or schematic block diagrams block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The schematic flowchart diagrams and/or schematic block diagrams in the Figures illustrate the architecture, functionality, and operation of possible implementations of apparatuses, systems, methods and computer program products according to various embodiments of the present invention. In this regard, each block in the schematic flowchart diagrams and/or schematic block diagrams may represent a module, segment, or portion of code, which comprises one or more executable instructions for implementing the specified logical function(s).

It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated figures.

Although various arrow types and line types may be employed in the flowchart and/or block diagrams, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment. It will also be noted that each block of the block diagrams and/or flowchart diagrams, and combinations of blocks in the block diagrams and/or flowchart diagrams, can be implemented by special purpose hardware-based systems that perform the specified functions or acts, or combinations of special purpose hardware and computer instructions.

FIG. 1 is a perspective view depicting one embodiment of a vehicle display system 100. The vehicle display system 100 includes a vehicle 102, one or more projectors 104, one or more mounting mechanisms 106, and a control module 108.

In the depicted embodiment, the vehicle 102 is a semi-trailer configured to be pulled by a truck. The semi-trailer includes an interior where goods may be placed for transportation within the semi-trailer. According to one embodiment, the vehicle 102 may be an unpowered vehicle such as a trailer, cart, or the like. For example, the vehicle 102 may include a street legal vehicle that is configured to be pulled by a powered vehicle. According to another embodiment, the vehicle 102 may be a powered vehicle such as a tractor truck, box truck, van, or any other powered vehicle. For example the vehicle 102 may include a gasoline, diesel, or electric motor, or the like. According to one embodiment, the vehicle 102 may include a trailer and a truck.

The projectors 104 may be devices which cast light to form an image. For example, the projectors 104 may be configured to cast light against a surface of the vehicle 102 to form one or more images 112. In one embodiment, the projectors 104 include projectors which are capable of quickly switching from one image to the next. For example, the projectors 104 may include digital video projectors which can receive data or a signal corresponding to an image, series, of images, and/or a video and cast light to visually display the received data or signal.

In one embodiment, the projectors 104 are mounted to the vehicle 102 via mounting mechanisms 106. The projectors 104 may be mounted on the vehicle such that an image created by the projector is cast on a surface of the vehicle. The mounting mechanisms 106 may be configured to engage the vehicle 102 and the projectors 104 such that the projectors are held substantially stationary with respect to the vehicle 102. In the depicted embodiment, the mounting mechanisms 106 engage an external surface of the vehicle 102 and hold the projectors 104 external to the vehicle 102. According to one embodiment, the projectors 104 are mounted such that they cast light against an outside surface of the vehicle. For example, in one embodiment, light from the projector encounters an exterior surface of the vehicle 102 from a direction external to the vehicle.

The projectors 104 may include any type of display elements for image projection known in the art. Exemplary projectors 104 may include cathode ray tube (CRT) projectors, liquid crystal display (LCD) projectors, digital light processing (DLP) projectors, any variations on these projector types, or the like. According to one embodiment, any type of digital, analog, or other projection system for displaying images may be used. In some embodiments, projectors 104 are configured to cast light on a surface that is a relatively large distance from the projector with the surface being substantially perpendicular to the direction in which the light is cast. In one embodiment, the projectors 104 are specifically configured to create images on a nearby surface and/or on surfaces that are substantially non-perpendicular to the projectors. For example, close through projectors may be used or projectors with lenses designed to compensate for resulting skew of images may be used.

Figure 2:
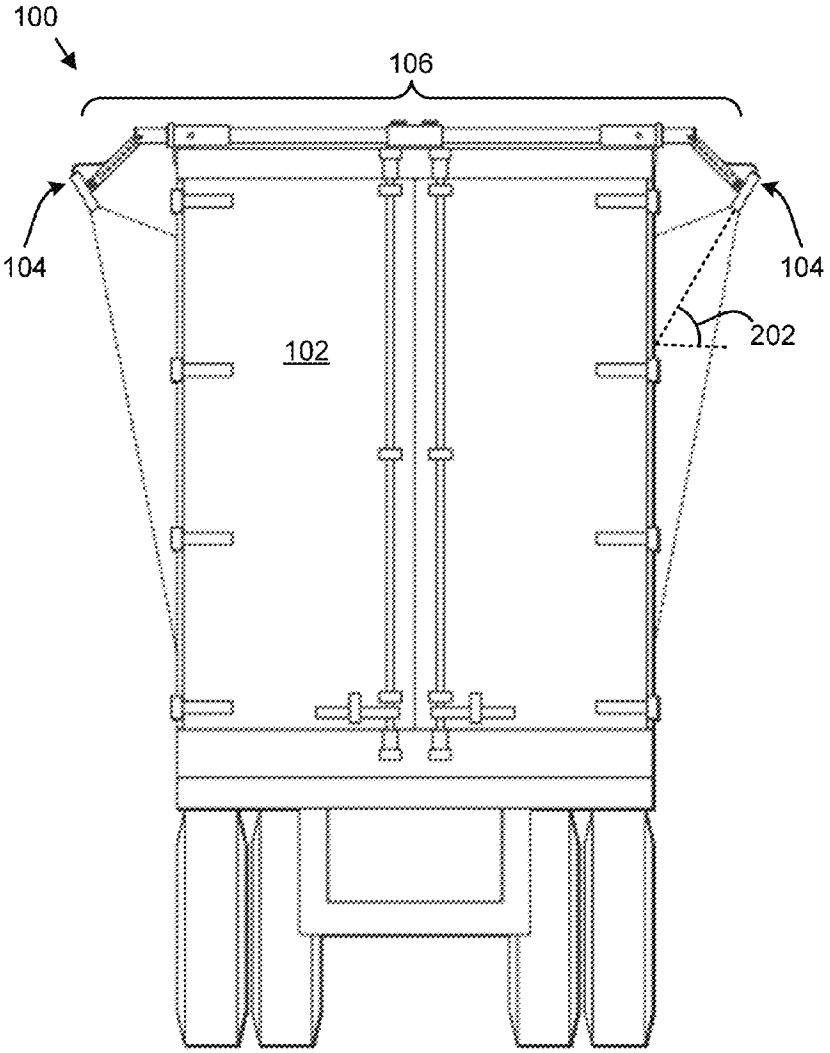
FIG. 2 is a side view of one embodiment of a vehicle display system in accordance with the present invention.

FIG. 2 is a rear view of the vehicle display system 100 and further illustrates exemplary projectors 104 and an exemplary mounting mechanism. Please note that the rear projectors 104 shown in FIG. 1 are not shown for clarity. The projectors 104 are shown supported by a mounting mechanism 106. In the depicted embodiment, the mounting mechanism 106 is attached to the top of the vehicle 102 and projectors 104 are adjustably mounted to the mounting mechanism 106. FIG. 2 further illustrates an exemplary angle 202 between the projector and the surface of the vehicle 102. In one embodiment, the angle 202 may require significant image correction for proper appearance on the side of the vehicle 102.

Figure 3:
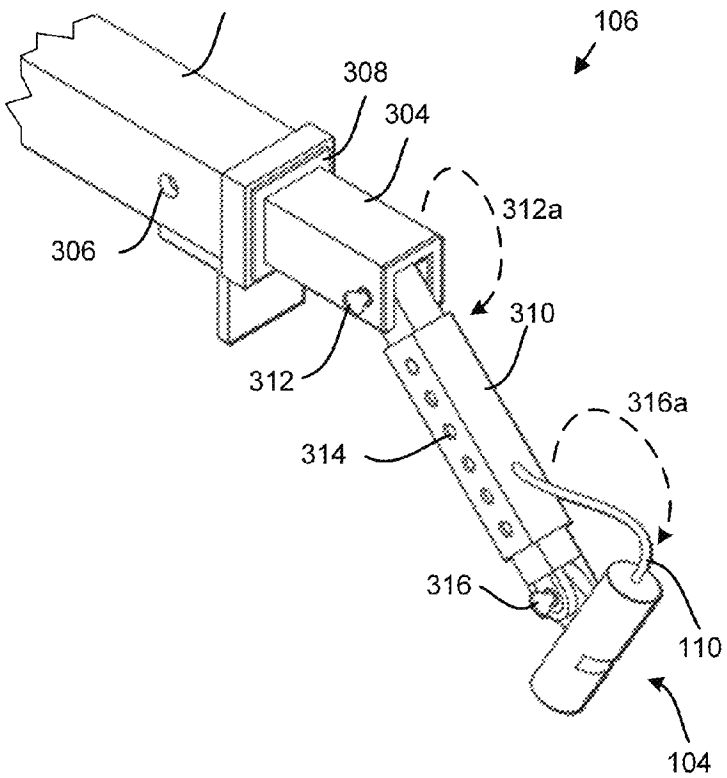
FIG. 3 is perspective view of one embodiment of a mounting mechanism and a projector in accordance with the present invention.

FIG. 3 is a close-up perspective view of a projector 104 mounted to a mounting mechanism 106, according to one embodiment. The exemplary mounting mechanism 106 includes a mounting tube 302, an insert 304, and an adjustable arm 310. The mounting tube 302 may be an elongated tube that can be secured to a vehicle 102. For example, the mounting tube 302 is depicted secured to the top of the vehicle 102 in FIG. 2. The mounting tube 302 and/or other portions of the mounting mechanism 106 may be formed of a variety of materials. In one embodiment, the mounting tube 302 and/or other portions of the mounting mechanism 106 are made of a structurally strong material such as a metal, plastic, fiberglass, or the like. According to one embodiment, the mounting tube 302 must be strong enough to securely hold other portions of the mounting mechanism 106 and a projectors against forces such as environmental wind, wind from movement of the vehicle 102, brushing up against other objects such as tree branches, or the like.

The insert 304 is depicted inserted within the mounting tube 302. The inset 304 may be held within mounting tube 302 using a pin or bolt inserted through a mounting tube hole 306. In one embodiment, a fitting 308 may be used to adapt the insert 304 to the size of the mounting tube 302 and/or dampen vibrations. Secure and tight fitting between the insert and mounting tube 302 and/or reduced vibrations may extend the useable life of the mounting mechanism 106 and/or projector 104. The adjustable arm 310 may be attached to the insert 304 via an arm fastener 312. In one embodiment, the arm fastener 312 may be selectively tightened or loosened to adjust an angle between the insert 304 and the adjustable arm 310. Rotation of the adjustable arm 310 with respect to the insert 304 as allowed by the arm fasten 312 is depicted by arrow 312*a*. The adjustable arm 310 may be adjustable in length using a pin or other mechanism within holes 314 to selectively secure the length of the adjustable arm 310 at a desired length.

In one embodiment, the projectors 104 may be attached to the adjustable arm 310 via a projector fastener 316. The projector fastener 316 may be may be selectively tightened or loosened to adjust an angle between the projector 104 and the adjustable arm 310. Rotation of the adjustable arm 310 with respect to the projector 104 as allowed by the projector fastener 316 is depicted by arrow 316*a*. In one embodiment, the mounting tube 302 and adjustable arm 310 may be hollow such that a communication line 110, power cord, or other line may be run through mounting mechanism 106 to provide power and/or communication to the projectors 104.

In one embodiment, the adjustable arm 310, arm fastener 312, and projector fastener 316 allow for substantial adjustment and customization for mounting to a desired vehicle. According to one embodiment, the mounting mechanism 106 and projectors 104 may be configured for attachment to a large number of different types of vehicles 102. For example, the mounting mechanism 106 may be configured for substantially universal mounting of projectors 104 to a variety of vehicle types such as box trucks, semi-trailers, and others. The adjustable nature of the mounting mechanism 106 may allow for the vehicle display system 100 to be used on a variety of vehicle or in a variety of different manners or configurations.

According to one embodiment, external mounting of the mounting mechanism 106 and/or projectors 104 may allow for substantially normal utilization of a vehicle 102. For example, if a vehicle 102 is designed for transportation of goods or individuals, an interior of the vehicle may be unaltered or occupied. Thus, goods or individuals may be transportable as if no vehicle display system 100 were being used. Additionally, mounting of the projectors 104 such that projected light encounters the vehicle 102 from an external direction may allow for the vehicle display system 100 to be used on already existing vehicle. According to one embodiment, no special screens may be required. In other embodiments, specialized configuration of a surface of the vehicle 102 may be performed to optimize the appearance of projected images. For example, cloth, selectively reflective material or screens may be used in some embodiments. Variations on display screens for optimized appearance of projected images is known in the art and any such variations or finishes may be applied to one or more locations on a vehicle to optimize appearance of projected images.

The elements and configuration of the mounting mechanism 106 are exemplary only. One of skill in the art will recognize the considerable variation possible in relation to mounting the projector 104 to a vehicle 102 to display images thereon.

Returning to FIG. 1, the vehicle display system 100 may include a control module 108. In one embodiment, the control module 108 is configured to provide images to the projectors 104 for display on a side of the vehicle 102. In one embodiment, a communication line 110 or other line may electrically connect the control module 108 to the projectors 104. In other embodiments, the control module 108 may communicate wirelessly with the projectors 104. According to one embodiment, the projectors 104 may be powered through the communication line 110 or some other wire or cable. According to one embodiment, the projectors and/or control module 104 may be powered by a trailer hookup, generator, or the like.

According to the depicted embodiment, the control module 108 has provided a signal or data corresponding to an image 112 of a skull to the projectors 104, which in turn are depicted displaying the image 112 on the sides and back of the vehicle 102. According to one embodiment, the control module 108 is capable of providing virtually any type of visual data to the projectors 104 for display on the vehicle. For example, a driver, passenger, or other individual with either physical or communication access to the control module 108 may change the visual content displayed. This may allow for almost immediate modification of the appearance of the vehicle 102.

Figure 4:
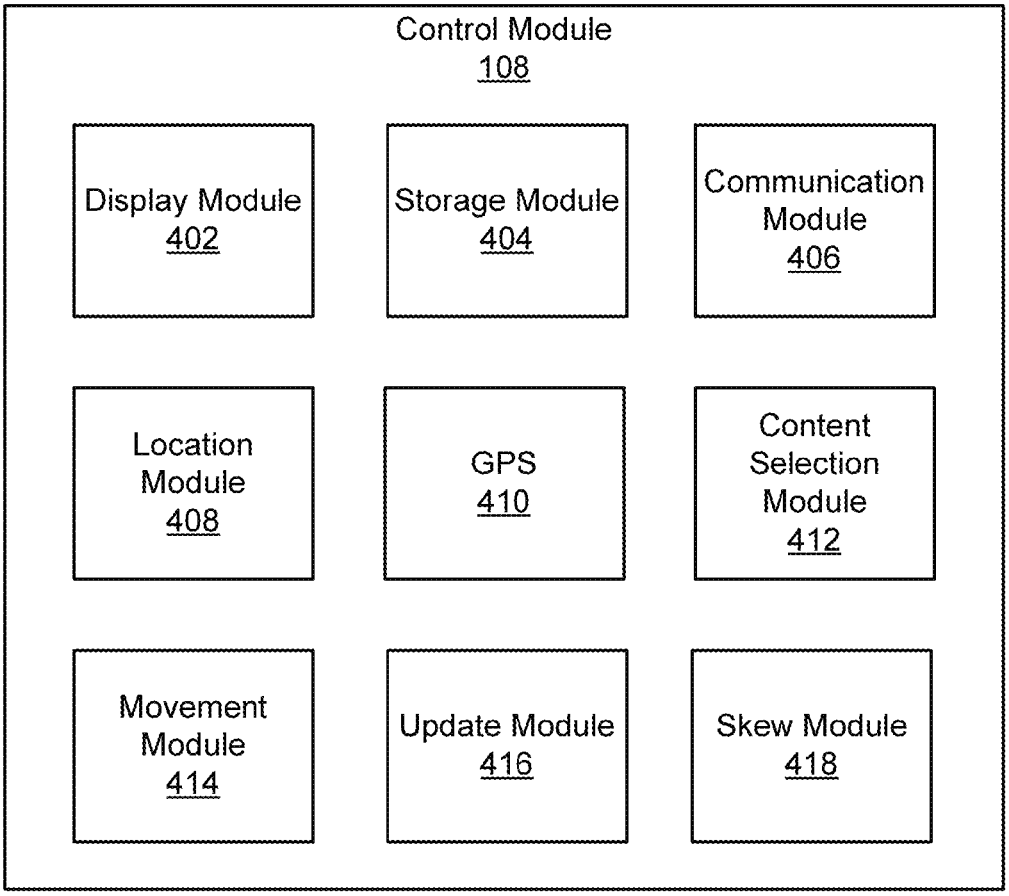
FIG. 4 is a schematic block diagram illustrating one embodiment of a control module in accordance with the present invention.

FIG. 4 illustrates a schematic block diagram of one embodiment of a control module 108. The depicted control module 108 includes a display module 402, a storage module 404, a communication module 406, a location module 408, a GPS 410, an content selection module 412, a movement module 414, an update module 416, and a skew module 418. It is important to note that not all modules 402-418 may be included in all embodiments. Varying embodiments may include only one or any combination of any two or more of the modules 402-418.

The control module 108 may include a display module 402 that provides images for display by the projectors 104. In one embodiment, the display module 402 may provide the images in the form of a signal or data that corresponds to images. For example, the display module 402 may include a processor, video card, or other device that generates a signal for transmission to the projectors. The display module 402 may send a signal or data using a network card or other communication device to the projectors 104. In one embodiment, the signal or data may be sent over a wired connection such as over the communication line 110. In one embodiment, the display module 402 may provide the signal or data wirelessly to the projectors 104.

In one embodiment, the display module 402 may provide any type of visual content to the projectors 104. In one embodiment, the display module 402 may be configured to provide one or more of still images, video, or other content. In one embodiment, the display module 402 may be capable of providing a different signal or different content to different projectors at substantially the same time. For example, if a vehicle display system 100 includes two or more projectors 104 the display module 402 may be configurable to display a different image on each of the projectors. According to one embodiment, the display module 402 may be configurable to display the same image on two or more projectors.

The control module 108 may include a storage module 404 for accessing display content data on a storage device. In one embodiment, the storage module 404 may include circuitry or a port for connecting to a storage device. According to one embodiment, the storage module 404 may be configured to access a storage device that is part of the control module 108. In one embodiment, the storage module 404 allows for the content available for display on by the display module 420 to be changed. For example, the storage module 404 may allow a user to insert a jump drive or other memory device to provide content for display. In one embodiment, the storage module 404 may allow for some content to be stored on the control module 108.

The control module 108 may include a communication module 406 for communicating another device. According to one embodiment, the communication module 406 allows for wired or wireless communication using one or more protocols. For example, the communication module 406 may be configured for communication using a wireless data network standard, a wireless computer network standard, Bluetooth®, or any other wireless communication standard. In one embodiment, the communication module 406 may be configured to communicate with a phone. In one embodiment, the communication module 406 may allow for wireless control of the control module 108 and/or the attached projectors 104. For example, a user with an application running on a smart phone may be able to communicate with the control module 108 and control the content displayed on the projectors 104.

The control module 108 may include a location module 408 that determines a current location of a vehicle 102. In one embodiment, the location module 408 may determine a current location of the vehicle 102 to which the vehicle display system 100 is mounted. In one embodiment, the location module 408 may determine the location of the vehicle 102 based on a signal from a global position system (GPS) enabled device. In one embodiment, the control module 108 may include a GPS 410. Thus, if the control module 108 is located with the vehicle 102, the GPS 410 may be able to determine the location based on a GPS signal and provide the location to the location module 408. In one embodiment, an external GPS 410 that is part of another device or system may be able to communicate with the control module 108 to provide location data.

The control module 108 may include a content selection module 412. The content selection module 412 may select content that corresponds to the current location of the vehicle display system 100 for display on the projectors 104. According to one embodiment, the content accessible to the control module 108, for example accessible by the storage module 404, may include desired location data to indicate locations at which the content should be displayed. The content selection module 412 may, using the desired location data select content that best corresponds to a certain location. The selected content may then be provided to the display module 402, for example, for display on the projectors 104. In one embodiment, the content selection module 412 may select content according to a variety of rules such that content is displayed at a proper time and/or location and according to a proper frequency. Additional rules may be based on a state or type of vehicle 102, input from a user in the vehicle, input from a remote user or device, or any other data. For example, the content selection module 412 may receive input from any of the other modules 402-410 or 416 which affects what content will be selected.

In one embodiment, the content for display that is accessible to the control module 108 may include advertising data. The advertising data may include, among other things, images, video, location, or other advertising data that may be displayed by projectors 104. For example, as a vehicle 102 traveling on a freeway having a vehicle display system 100 is approaching a certain exit the content selection module 412 may select advertising content that corresponds to goods or services offered at a location accessible through the exit. This selected content may then be displayed on the vehicle 102 using the projectors 104 such that cars or individuals located nearby may see the advertisement. This may help drive customers, tourists, or others to the offeror of the goods or services.

According to one embodiment, the content for selection, the location of the vehicle 102, and/or other data may be logged by the control module 108 or may be communicated using the communication module 406 for tracking of what advertisements have been used, where, etc.

The control module 108 may include a movement module 414 that determines whether the vehicle 102 is moving. For example, the control module 108 may detect movement based on locations determined by the location module 408 over time. In one embodiment, the movement module 414 may detect a varying location based on GPS or any other type of sensor or input and determine that the vehicle 102 is moving. According to one embodiment, a determination that the vehicle 102 is moving may affect what content is selected for display by the content selection module 412. For example, traffic laws or other laws may control what type of content can be displayed on a moving vehicle or near moving vehicles. According to one embodiment, only content that meets the requirements of the laws will be selected.

According to one exemplary scenario, it may be illegal to distracting images, video, or other types of content on a moving vehicle. According to such a scenario, the movement module 414 may restrict the display of any content that includes distracting images, video, or other prohibited content in response to determining that the vehicle 102 is moving. For example, when moving down a road only still images (i.e., static images) or images that change infrequently, are displayed by the projectors. Alternatively, if the vehicle 102 is not moving there may be perhaps no restrictions on the content that can be displayed.

The control module 108 may include an update module 416 for updating the control module 108. According to one embodiment, the update module 416 may be configured to download and/or install updates to code, content, or any other aspect of the control module 108.

The control module 108 may include a skew module 418 that adjusts an image to compensate for distortion resulting from an angle of projection. For example, FIG. 2 illustrates an exemplary angle 202 between the projectors 104 and a surface of the vehicle 102. In one embodiment, angles other than substantially perpendicular angles with respect to a surface of the vehicle can lead to vertically skewed, horizontally skewed, or otherwise distorted images. In one embodiment, the skew module 418 may adjust the image such that angle is compensated for and the image does not appear distorted on the vehicle 102 surface.

In one embodiment, compensation for the angle may be done through processing, such as calculating the effect of an angle and adjusting the image digitally to create a skewed image that, when projected, appears undistorted. For example, an image may be digitally "keystoned" such that it appears non-keystoned or undistorted when projected against the vehicle 102. In another embodiment, a lens or other device may be used on the projector itself to compensate for any non-perpendicular projection angle. According to one embodiment, the skew module 418 or a lens may also compensate for varying brightness between portions of the image based on the projection angle. According to one embodiment, compensation for display angles may be built into the projectors 104 themselves. For example, a lens or a skew module 418 may be included within each projector 104.

In one embodiment, not all modules 402-418 may be located within the same device. For example, the control module 108 may include one or more devices. According to one embodiment, some modules may be included in a control module while other modules may be included in software running on a separate device. For example, a device in communication with the control module 108 or the vehicle display system 100 may include some modules that communicate with the control module 108 or other components of the vehicle display system 100. In one exemplary embodiment, the display module 402 and communication module 406 may be located within a control module 108 mounted on a vehicle while one or more of the other modules 404, 408-418 may be located within software running on a phone, remote server or computer, or other device.

In one embodiment, the control module 108 may include a smart phone, laptop computer, pad computer, desktop computer, or any other computer device running software the corresponds to one or more of the modules 402-418. In one embodiment, a smart phone may run an app that communicates with a vehicle display system 100 to control one or more aspects of its operation. For example, a control module 108 that includes one or more of the modules 402-418 may be mounted on a vehicle 102 while multiple different individuals may have their own phones that have software implementing the functions of one or more of the modules 402-418. In one embodiment, drivers, passengers, or other individuals may be able to transfer vehicles 102 and still be able control the display of content on the projectors 104 without transferring or changing possession of a device.

Figure 5A:
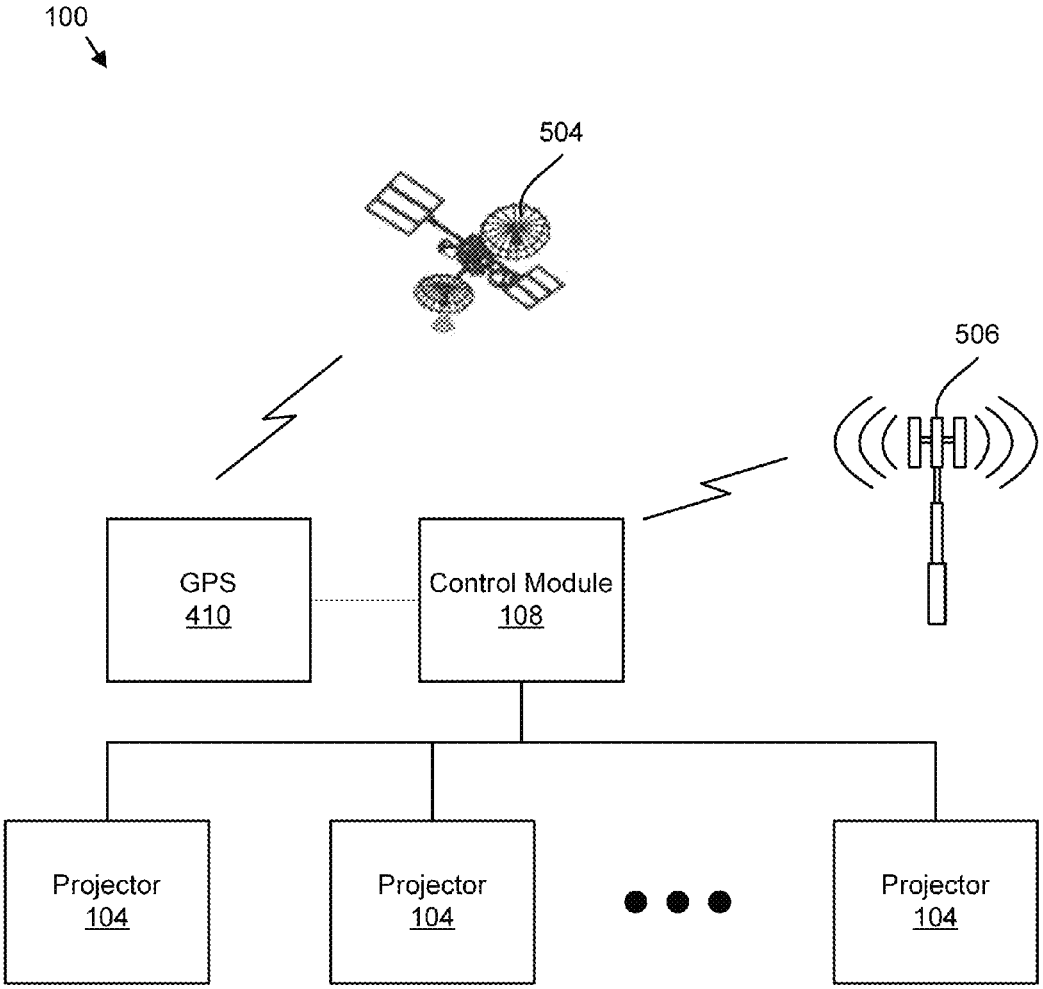
FIGS. 5A and 5B are schematic diagram illustrating embodiments of a vehicle display systems in accordance with the present invention.

FIG. 5A is a schematic diagram of a vehicle display system 100 depicting exemplary interconnection of components. The vehicle display system 100 includes a control module a plurality of projectors 104 and a GPS 410. The GPS 410 receives a GPS signals from satellites 504 and provide location date to the control module 108. The control module communicates with an antenna 506. The antenna 506 may be connected to a wireless data network. The control module 108 communicates with projectors 104 to control display of images on a surface of a vehicle 102.

Figure 5B:
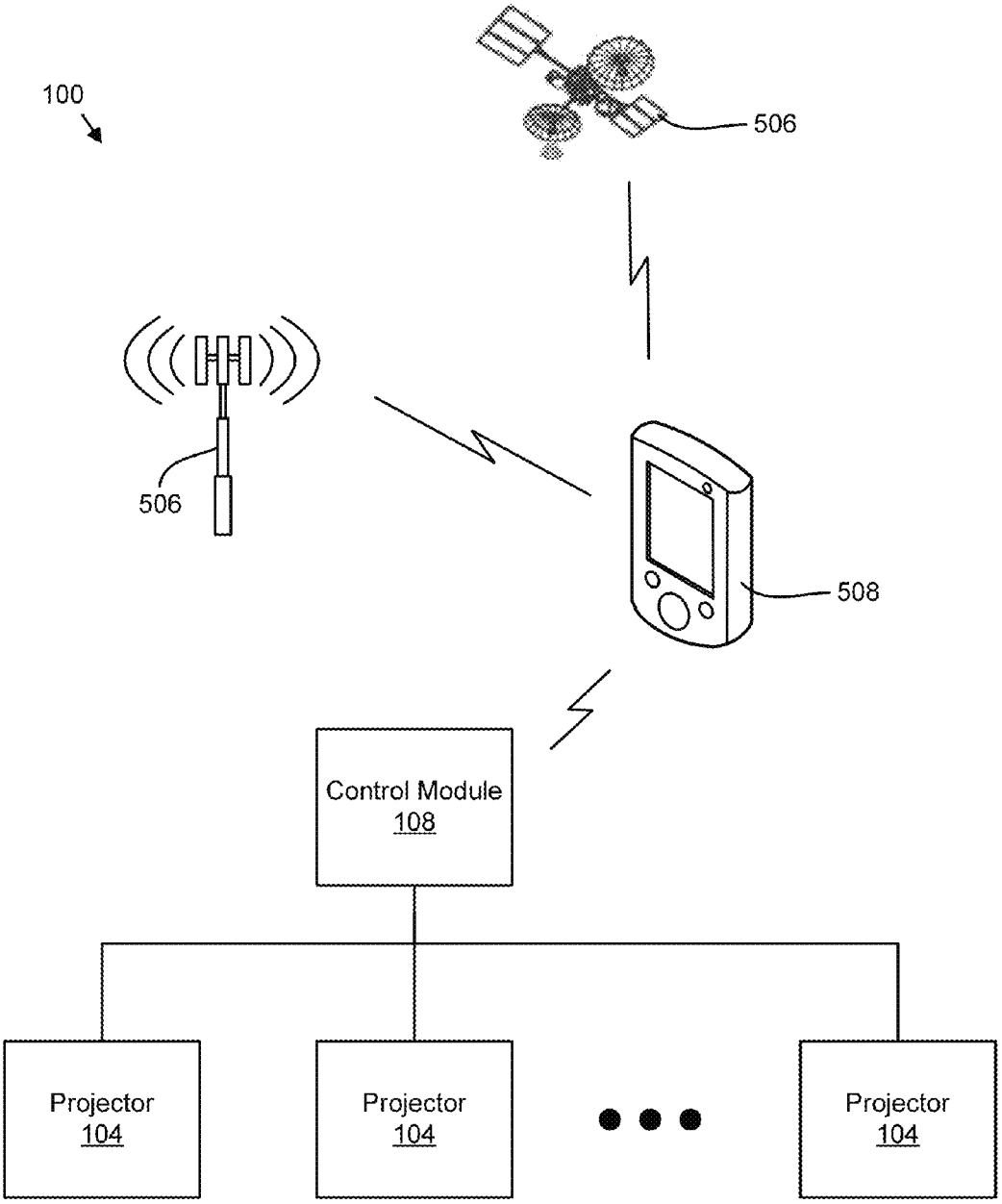

FIG. 5B is a schematic diagram of a vehicle display system 100 depicting exemplary interconnection and/or communication between components. The vehicle display system 100 includes a control module and a plurality of projectors 104. The control module 108 is in wireless communication with a smart phone 508. The smart phone 508 is in communication with GPS satellites 504 and a wireless data network through an antenna 506. The smart phone 508 may provide options to a user to control the control module 108. The control module 108 is in communication with the projectors 104 to display selected content.

Figure 6:
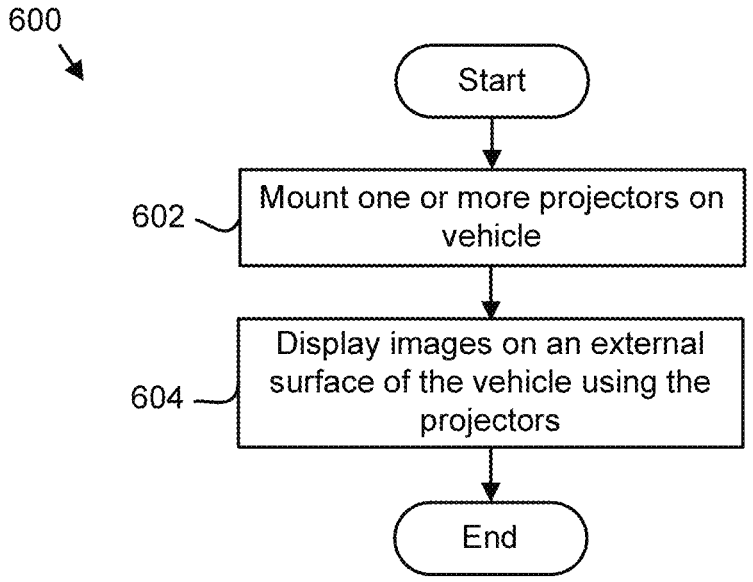
FIG. 6 is a schematic flow chart diagram illustrating one embodiment of a method for displaying content on a vehicle in accordance with the present invention.

FIG. 6 is a schematic flow chart diagram illustrating one embodiment of a method 600 for displaying content on a vehicle 102. According to one embodiment, the method may be used with a vehicle display system 100.

The method 600 starts and one or more projectors 104 are mounted 602 on a vehicle. The projectors 104 may be mounted using one or more mounting mechanisms 106. The projectors 104 may be mounted such that light from the projectors 104 encounters an external surface of the vehicle 102 from a direction external to the vehicle. The vehicle 102 may have a finish configured to optimize appearance of a projected image. In one embodiment, the vehicle 102 may have a conventional color or finish.

Images are displayed 604 on an external surface of the vehicle 102 using the projectors 104. The images may be part of any type of visual content including still image, text, video content, or any other visual content.

Figure 7:
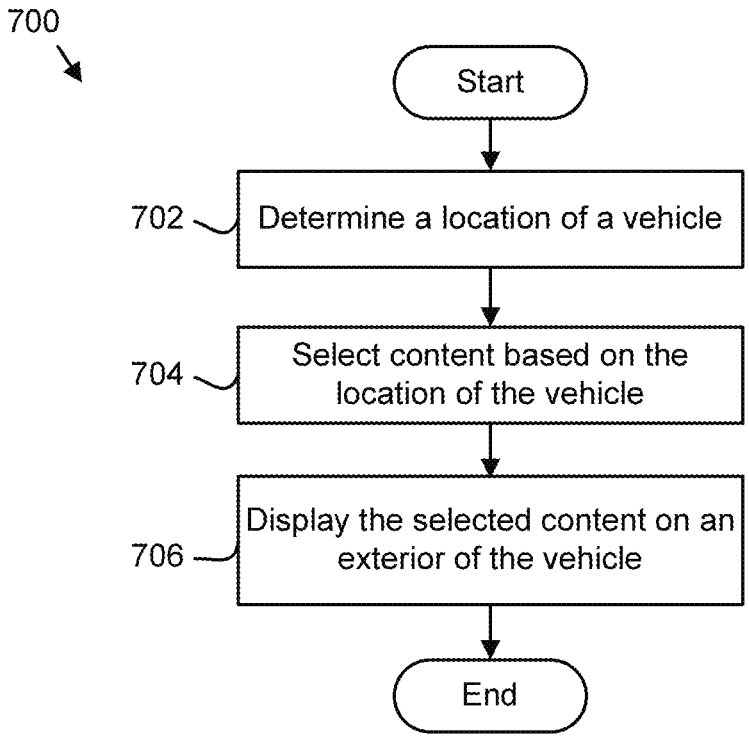
FIG. 7 is a schematic flow chart diagram illustrating one embodiment of a method for displaying content on a vehicle based on location of the vehicle in accordance with the present invention.

FIG. 7 is a schematic flow chart diagram illustrating one embodiment of a method 700 for displaying content vehicle 102 based on a location of a vehicle. In one embodiment, the method 700 is performed by a vehicle display system 100.

The method begins and a location module 408 determines 702 a location of a vehicle 102. The location module 408 may determine 702 the location of the vehicle 102 based on any type of input device known in the art. In one embodiment, the location of the vehicle 102 is determined 702 based on a GPS signal from a plurality of satellites.

A content selection module 412 selects 704 content based on the location of the vehicle 102. The content may include location information or other information that the content selection module 412 uses to select 704 content for display. In one embodiment, the content for display includes advertising content.

One or more projectors 104 and/or a display module 402 display 706 the selected content on the vehicle 102. The content may be displayed on an external surface of the vehicle 102 for observation by nearby individuals. For example, individuals or cars or on the street near the vehicle 102 may be able to observe the displayed 706 content. In one embodiment, the content is displayed using a projector 104 mounted on the vehicle.

Figure 8:
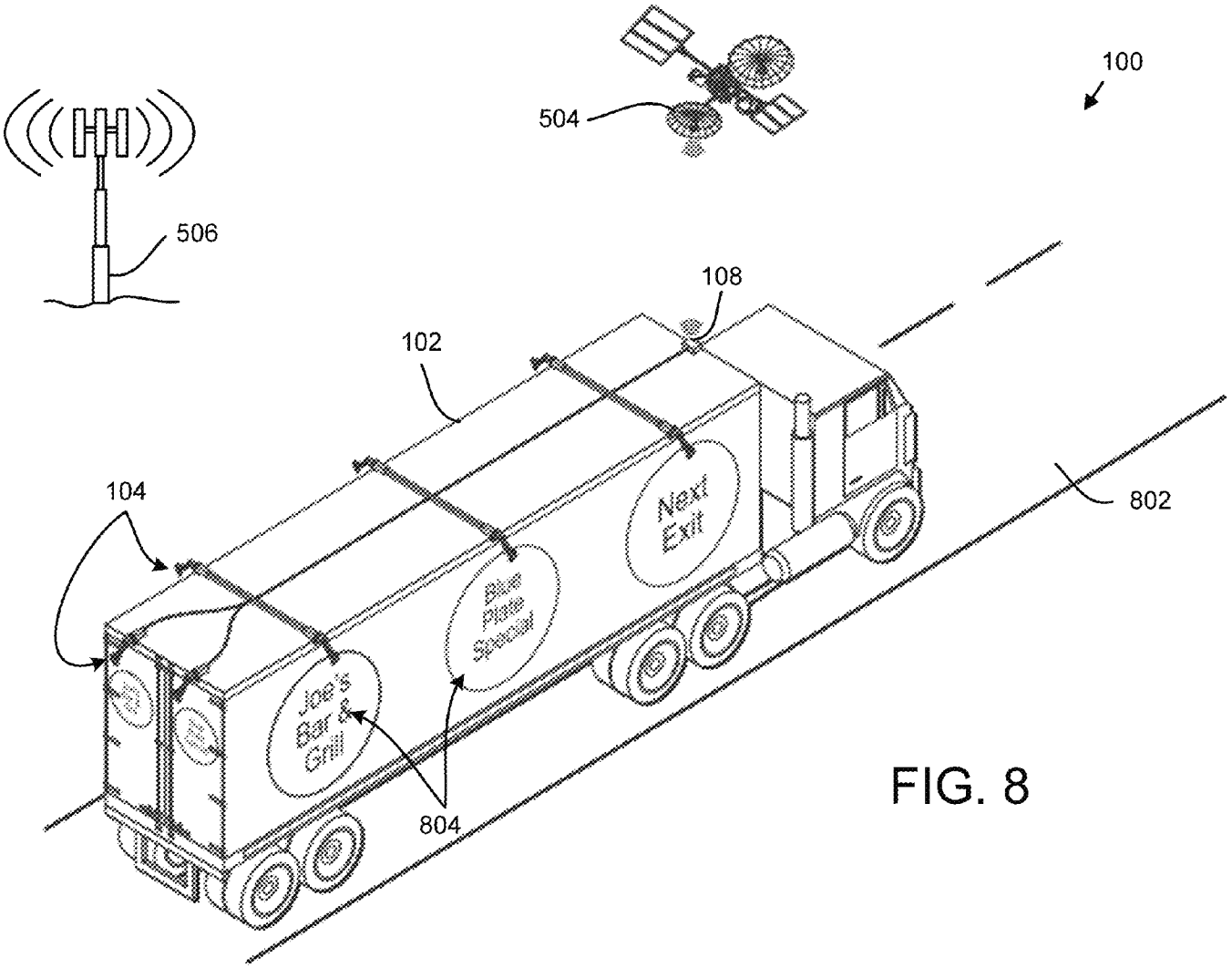
FIG. 8 is perspective view of one embodiment of a vehicle display system displaying location based content in accordance with the present invention.

FIG. 8 is perspective view of one embodiment of a vehicle display system 100 displaying location based content in accordance with the present invention. The vehicle 102 is shown driving down a road 802. The vehicle 102 has projectors 104 and a control module 108 mounted on top of the vehicle 102. The control module 108 receives a GPS signal from satellites 504 and determines a current location. The control module 108 may also communicate with an antenna 506 for a data network. The control module 108 provides location based content to the projectors 104 which then display the location based content. The projectors 104 are depicted displaying images 804 that advertise for Joe's Bar & Grill at the next exit as well as a special that is available. The control module 108 may receive the location based content from the antenna 506 for the data network.

Figure 9:
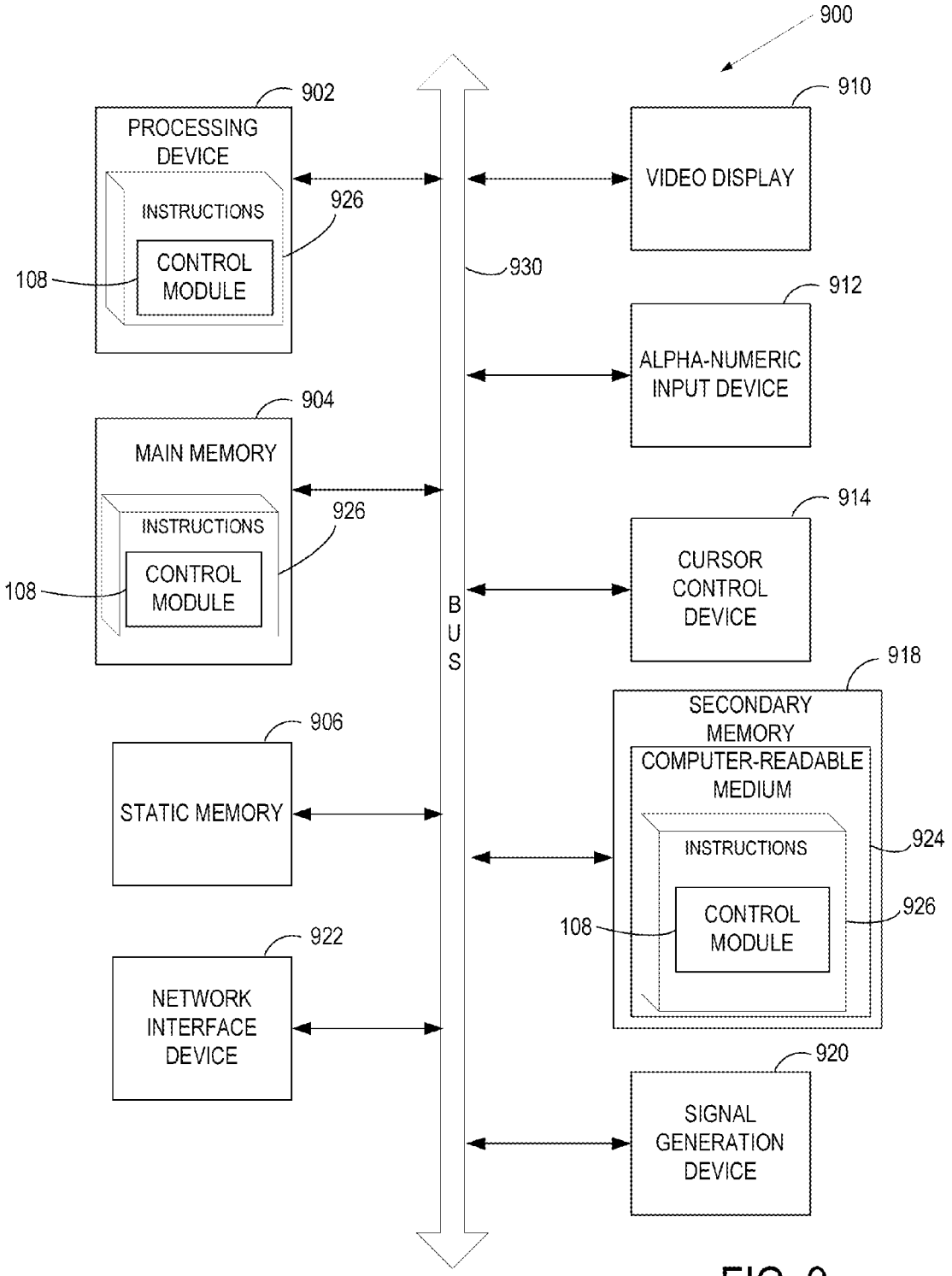
FIG. 9 illustrates a diagrammatic representation of a machine in the exemplary form of a computing system within which a set of instructions, for causing the machine to perform any one or more of the methodologies described herein, may be executed.

FIG. 9 illustrates a diagrammatic representation of a machine in the exemplary form of a computing system 900 within which a set of instructions, for causing the machine to perform any one or more of the methodologies discussed herein, may be executed. Within the computer system 900 is a set of instructions for causing the machine to perform any one or more of the methodologies discussed herein. In alternative embodiments, the machine may be connected (e.g., networked) to other machines in a LAN, an intranet, an extranet, or the Internet. The machine can be a host in a cloud, a cloud provider system, a cloud controller or any other machine. The machine can operate in the capacity of a server or a client machine in a client-server network environment, or as a peer machine in a peer-to-peer (or distributed) network environment. The machine may be a personal computer (PC), a tablet PC, a console device or set-top box (STB), a Personal Digital Assistant (PDA), a cellular telephone, a web appliance, a server, a network router, switch or bridge, or any machine capable of executing a set of instructions (sequential or otherwise) that specify actions to be taken by that machine. Further, while only a single machine is illustrated, the term "machine" shall also be taken to include any collection of machines (e.g., computers) that individually or jointly execute a set (or multiple sets) of instructions to perform any one or more of the methodologies discussed herein.

The computer system 900 includes a processing device 902, a main memory 904 (e.g., read-only memory (ROM), flash memory, dynamic random access memory (DRAM) such as synchronous DRAM (SDRAM) or DRAM (RDRAM), etc.), a static memory 906 (e.g., flash memory, static random access memory (SRAM), etc.), and a secondary memory 918 (e.g., a data storage device in the form of a drive unit, which may include fixed or removable computer-readable storage medium), which communicate with each other via a bus 930.

Processing device 902 represents one or more general-purpose processing devices such as a microprocessor, central processing unit, or the like. More particularly, the processing device 902 may be a complex instruction set computing (CISC) microprocessor, reduced instruction set computing (RISC) microprocessor, very long instruction word (VLIW) microprocessor, processor implementing other instruction sets, or processors implementing a combination of instruction sets. Processing device 902 may also be one or more special-purpose processing devices such as an application specific integrated circuit (ASIC), a field programmable gate array (FPGA), a digital signal processor (DSP), network processor, or the like. Processing device 902 is configured to execute the instructions 926 for performing the operations and steps discussed herein.

The computer system 900 may further include a network interface device 922. The computer system 900 also may include a video display unit 910 (e.g., a liquid crystal display (LCD) or a cathode ray tube (CRT)) connected to the computer system through a graphics port and graphics chipset, an alphanumeric input device 912 (e.g., a keyboard), a cursor control device 914 (e.g., a mouse), and a signal generation device 920 (e.g., a speaker).

The secondary memory 918 may include a machine-readable storage medium (or more specifically a computer-readable storage medium) 924 on which is stored one or more sets of instructions 926 embodying any one or more of the methodologies or functions described herein. In one embodiment, the instructions 926 include instructions for the control module 108 as described herein. The instructions 926 may also reside, completely or at least partially, within the main memory 904 and/or within the processing device 902 during execution thereof by the computer system 900, the main memory 904 and the processing device 902 also constituting machine-readable storage media.

The computer-readable storage medium 924 may also be used to store the instructions 926 persistently. While the computer-readable storage medium 924 is shown in an exemplary embodiment to be a single medium, the term "computer-readable storage medium" should be taken to include a single medium or multiple media (e.g., a centralized or distributed database, and/or associated caches and servers) that store the one or more sets of instructions. The term "computer-readable storage medium" shall also be taken to include any medium that is capable of storing or encoding a set of instructions for execution by the machine and that cause the machine to perform any one or more of the methodologies of the present invention. The term "computer-readable storage medium" shall accordingly be taken to include, but not be limited to, solid-state memories, and optical and magnetic media.

The instructions 926, components and other features described herein can be implemented as discrete hardware components or integrated in the functionality of hardware components such as ASICS, FPGAs, DSPs or similar devices. In addition, the instructions 926 can be implemented as firmware or functional circuitry within hardware devices. Further, the instructions 926 can be implemented in any combination hardware devices and software components.

In the above description, numerous details are set forth. It will be apparent, however, to one of ordinary skill in the art having the benefit of this disclosure, that embodiments of the present invention may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "monitoring," "identifying," "generating," "providing," "selecting," "obtaining," "receiving," "deleting," "executing," "requesting," "communicating," or the like, refer to the actions and processes of a computing system, or similar electronic computing device, that manipulates and transforms data represented as physical (e.g., electronic) quantities within the computing system's registers and memories into other data similarly represented as physical quantities within the computing system memories or registers or other such information storage, transmission or display devices.

The words "example" or "exemplary" are used herein to mean serving as an example, instance or illustration. Any aspect or design described herein as "example' or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or." That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an embodiment" or "one embodiment" or "an implementation" or "one implementation" throughout is not intended to mean the same embodiment or implementation unless described as such.

Embodiments descried herein may also relate to an apparatus for performing the operations herein. This apparatus may be specially constructed for the required purposes, or it may comprise a general-purpose computer selectively activated or reconfigured by a computer program stored in the computer. Such a computer program may be stored in a non-transitory computer-readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, flash memory, or any type of media suitable for storing electronic instructions. The term "computer-readable storage medium" should be taken to include a single medium or multiple media (e.g., a centralized or distributed database and/or associated caches and servers) that store the one or more sets of instructions. The term "computer-readable medium" shall also be taken to include any medium that is capable of storing, encoding or carrying a set of instructions for execution by the machine and that causes the machine to perform any one or more of the methodologies of the present embodiments. The term "computer-readable storage medium" shall accordingly be taken to include, but not be limited to, solid-state memories, optical media, magnetic media, any medium that is capable of storing a set of instructions for execution by the machine and that causes the machine to perform any one or more of the methodologies of the present embodiments.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the embodiments as described herein.

The above description sets forth numerous specific details such as examples of specific systems, components, methods and so forth, in order to provide a good understanding of several embodiments of the present invention. It will be apparent to one skilled in the art, however, that at least some embodiments of the present invention may be practiced without these specific details. In other instances, well-known components or methods are not described in detail or are presented in simple block diagram format in order to avoid unnecessarily obscuring the present invention. Thus, the specific details set forth above are merely exemplary. Particular implementations may vary from these exemplary details and still be contemplated to be within the scope of the present invention.

It is to be understood that the above description is intended to be illustrative and not restrictive. Many other embodiments will be apparent to those of skill in the art upon reading and understanding the above description. The scope of the invention should, therefore, be determined with reference to the appended claims, along with the full scope of equivalents to which such claims are entitled. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A system comprising:

a vehicle towing a trailer, where the trailer comprises a substantially enclosed container having a top, a front end, a rear end, a pair of sides, and a floor;

one or more projectors, each of the one or more projectors coupled, via a mounting mechanism, to the top of the trailer and extends outward such that an image created by the projector is cast on an exterior surface of one of the pair of sides, where the mounting mechanism comprises a selectively extendable arm that extends in a direction that is substantially parallel to a plane of the top;

a movement module configured to determine if the vehicle is stationary;

a content selection module configured to select an image that is static in response to a determination that the vehicle is moving, and select a video in response to a determination that the vehicle is stationary; and a control module configured to provide, in response to the selection, the selected image or the selected video to the one or more projectors for projecting on the exterior surface of the vehicle, where the control module receives power from the vehicle.

2. The system of claim 1, wherein the control module is configured to provide image information corresponding to the images.

3. The system of claim 1, wherein the control module comprises a skew module for compensating for a non-perpendicular angle of projection.

4. An apparatus comprising:

a movement module that determines if a vehicle towing a trailer is one of stationary or moving, where the trailer comprises a substantially enclosed container having a top, a front end, a rear end, a pair of sides, and a floor;

a content selection module that selects an image that is static in response to a determination that the vehicle is moving, and selects a video in response to a determination that the vehicle is stationary;

a control module that provides either the selected image or video to one or more projectors for projecting on an exterior surface of the trailer, where each of the one or more projectors is coupled, via a mounting mechanism, to the top of the trailer and extends outward such that the image or video is cast on an exterior surface of one of the pair of sides, where the mounting mechanism comprises a selectively extendable arm that extends in a direction that is substantially parallel to a plane of the top, and where the control module receives power from the vehicle; and where the movement module, the content selection module, and the display module each comprise one or more of logic hardware and computer executable code stored on a non-transitory computer readable storage medium.

5. The apparatus of claim 4, wherein the location module receives location information from a global positioning system (GPS) enabled device.

6. The apparatus of claim 4, wherein the location module comprises a global positioning system (GPS) enabled device.

7. The apparatus of claim 4, wherein the apparatus comprises a phone.

8. The apparatus of claim 4, further comprising a communication module for communicating with one or more devices.

9. The apparatus of claim 8, wherein the communication module is configured to communicate with a phone.

10. The apparatus of claim 9, wherein the phone comprises an application for interfacing with the communication module.

11. The apparatus of claim 9, wherein the communication module is configured to communicate wirelessly.

12. The apparatus of claim 9, further comprising a storage module for accessing content data on a storage device.

13. The apparatus of claim 4, wherein the display module provides different images to different projectors at substantially simultaneous display.

* * * * *